US006073704A

United States Patent [19]

Yasuoka et al.

[11] Patent Number: 6,073,704

[45] Date of Patent: Jun. 13, 2000

[54] MACHINE SUPPORT INCLUDING MEANS FOR ANGULAR CONTROL OF A SUPPORTED DEVICE

[75] Inventors: Kazuhiko Yasuoka; Sinichi Okabayasi; Akira Nishimura; Keiichi Nakamura, all of Kochi, Japan

[73] Assignee: Tosa Machinery Industries Co., Ltd., Japan

[21] Appl. No.: 08/909,033

[22] Filed: Aug. 11, 1997

[51] Int. Cl.[7] ..... E02D 7/18

[52] U.S. Cl. ..... 173/32; 173/37; 173/49; 173/130; 175/55

[58] Field of Search ..... 173/49, 32, 31, 173/1, 37, 33, 129, 130, 132, 44; 405/231, 232, 228; 175/55; 254/29 R

[56] References Cited

U.S. PATENT DOCUMENTS

| | | | |
|---|---|---|---|
| 2,554,146 | 5/1951 | Johns | 173/130 |
| 3,149,851 | 9/1964 | Adams | 173/132 |
| 3,243,190 | 3/1966 | Peregrine | 173/130 |
| 3,289,774 | 12/1966 | Bodine, Jr. | 175/55 |
| 3,368,632 | 2/1968 | Lebelle | 173/49 |
| 3,828,864 | 8/1974 | Haverkamp et al. | 173/49 |
| 4,018,290 | 4/1977 | Schmidt | 173/49 |
| 4,195,698 | 4/1980 | Nakagawasai | 173/44 |
| 4,248,550 | 2/1981 | Blaschke et al. | 173/49 |
| 5,609,380 | 3/1997 | White | 405/232 |
| 5,823,272 | 10/1998 | Van Halteren | 173/49 |

*Primary Examiner*—Peter Vo
*Assistant Examiner*—James Calve
*Attorney, Agent, or Firm*—Morrison Law Firm

[57] ABSTRACT

Supporting clamps for a tool such as, for example, a pile driver machine are used to tilt a machine support relative to a horizontal plane. The clamps include a pair of jaw elements one of which is received on a pivot and the other of which has a pair of parallel spaced pistons. The clamp jaw elements gird a fixed reference device to support the tool securely for subsequent operations. Different pressures applied to the two pistons causes the clamp to tilt about the fixed reference device, and thereby to tilt the tool to which it is attached. The difference in pressure is controlled to rotate the tool as desired. In a second embodiment of the invention, the desired angle is established by controlling an angle of a backup surface, and applying equal pressure to the two pistons. The fixed reference device is driven into the angled backup surface to establish the desired tilt angle. In a further embodiment, one piston is disposed at each side of the gap. The two pistons are spaced apart along the gap. A fixed clamping element is disposed outside the line defined by the two pistons. Separate fluid pressures applied to the two pistons both urge one side of a the fixed reference device against the fixed clamping element, and also controls the angle of the clamp about the fixed clamping element. Other embodiments include four pistons in opposed pairs controlled by at least two independently controlled fluid pressures.

1 Claim, 11 Drawing Sheets

MACHINE SUPPORT INCLUDING MEANS FOR ANGULAR CONTROL OF A SUPPORTED DEVICE

BACKGROUND OF THE INVENTION

The present invention relates to a machine support which includes a device for controlling an angle of a supported tool.

Although any application of the machine support is contemplated within the scope of the invention, for definiteness, the present invention is described in the environment of pile driver machines. In this environment, the pile driver machine includes means to tilt a machine support and therewith dispose a desired axis of the pile driver machine in a desired angular relationship to a pile gripped by the machine support.

Pile driving is an activity associated with a wide range of industrial activities such as constructing building foundations, erecting tidal flow incursion barriers etc. In erecting a pile course, piles are driven individually into the ground in a, e.g., longitudinal succession of such. Other than longitudinal courses also are used where deviation from the longitudinal is necessary to follow a ground contour change. Further, a given longitudinal course will have an end point whereat a new course, for example disposed at a right angle to the first will be driven this being a common occurrence where a pile enclosure of encircling character is required.

Further practice involves providing shaped and mating interengageable or interlockable longitudinal side edges on the pile workpieces to allow production of a contiguous and well-aligned pile course, a result particularly called for where the course is to establish a water barrier as at waterfront site location. Cross section configurations of the piles most usually will be of channel shape although other and special purpose cross sections for piles are well known.

Driving of the piles for many years was effected with a pile driver unit powered by steam, cable lift or other means which functioned to lift a heavy weight driver block to a height above the top end of a generally vertically disposed pile workpiece held at the location at which it was to be driven into the ground. The lifted weight driver would then be released to fall along a guided course until it struck the top of the workpiece transferring the kinetic energy of the falling weight driver into the pile workpiece as a force driving the pile workpiece downwardly a short distance into the ground with each strike. This cycle of weight driver lifting and release was repeated until the pile workpiece was driven the required distance below ground or seabed level.

Attending this practice was creation of great and frequently damage producing levels of noise and vibration, conditions accepted because there was no viable or practical alternative manner known for pile driving. Vibration incident pile driving operations always has on occasion, damaged or even demolished buildings and other structures in the vicinity of the driving operation. Noise not only is bothersome to humans living or working near the pile driving, but it also has caused physical injury to some.

Some years back there was introduced apparatus for driving piles in an essentially noiseless, vibration-free operation. With this apparatus, a pile workpiece is held or securely gripped in the chuck of a work holder. Driving of the workpiece into the ground is then carried out by stroking of hydraulic cylinders attached to the work holder. At the end of each stroke, the chuck is released, moved upward and re-clamped on the workpiece to continue downward driving with a new stroke. Since the operating pressure of the hydraulic cylinders is very high being, e.g., about 350 kg per centimeter squared, a pile easily is pressed or pushed down into the ground, this being done without any measurable noise creation or manifestation of vibration. Exemplary of this type of pile driver apparatus are TSM type units made and sold by Tosa Machinery Industries Co., Ltd of Kochi City, Japan under the name STILL WORKER, one of ordinary skill in the art being well aware of the construction and function features of such machines.

During operation of the TSM apparatus, a carriage on which the work holder and driving cylinders are mounted and set on a table or support are clamped to a line of plural ones of previously driven piles so that these previously driven piles anchor the carriage against any upward movement as a reaction to the downward driving force exerted in the driving of a pile. The apparatus also works to "walk" along the pile course since the table or support can be unclamped at a location on the piles and slid along on a further number of the driven piles to a new table clamping location while the carriage structure is being supported with the work holder structure on a frontmost (last driven) one of the piles.

This apparatus embodies means to tilt the chuck to a limited degree (about 5 degrees) with respect to the table at the fore and aft apparatus ends as viewed along the driving course plane. This assures that the vertical axis of the pile is driven (in the dimension of the plane) with the verticality to a horizontal datum plane as desired or intended. It is desirable that apparatus of this type also be provided with means to ensure proper maintenance of pile vertical axis disposition in a plane of a second dimension crosswise to the first, i.e., and which means allow easy tilting of the carriage to the left and right sides of same to accomplish this and further, that such means be useful in respect of orienting components such as tool holders, workpieces of other types and purpose apparatus where simplicity and surety of orientation accomplishment are essential.

OBJECTS AND SUMMARY OF THE INVENTION

Accordingly, it is an object of the invention to provide a clamping device which includes angular control with respect to an object on which it is clamped.

It is a further object of the invention to provide a clamping device for supporting a pile driver machine which overcomes the drawbacks of the prior art.

It is a further object of the invention to provide a pile driver machine having mechanism for tilting the pile driving component thereof at right and left ends and, hence, effecting corresponding tilting of a machine gripped pile longitudinal axis in one dimension, with means to effect tilting of the driving component from front to rear so that disposition of the pile longitudinal axis in a second dimension crosswise to the first also can be controlled and particularly so as same is concerned with positioning the pile longitudinal axis in vertical perpendicular relationship to a horizontal datum plane.

It is a still further object of the invention to provide machine component tilting means which can be used generally for orienting tools, workpieces of other description, article holders etc so that desired orientation of same for specific purpose readily can be made.

A further object of the invention is to provide a support orienting means which is of uncomplicated construction and sure and certain in manner of operation to effect an intended workpiece/tool/holder positioning.

Briefly stated, there is provided a pile driver machine which includes a carriage mounting a pile driving component mounted on a support. The support in turn is mounted on a fixed base by means of clamps carried by the support. The clamps include a pair of jaw elements one of which is received on a pivot and the other of which has a pair of parallel spaced pistons. The clamp jaw elements gird the top part of a prior driven pile which constitutes the fixed base and in clamping mode hold the support and carriage securely for and during pile driving operation. At least one but preferably both pistons of the other jaw element is slidable in the jaw element and caused to slide by fluid pressure acting thereon so that the pistons can engage a side of the pile top part. By applying pressure at different values to the pistons, one at a lower pressure can be caused to stop against a side of the pile top part while the other at a higher pressure when slid against the same pile side causes a reaction result that effects rotation of the support about the pivot of the first jaw element. Depending on the pressure involved, the support rotation will be that necessary to tilt or orient the support either to the front or to the rear side the amount necessary to dispose the longitudinal axis of a pile workpiece gripped in the chuck of the carriage at a desired vertical angulation (in one dimension) with respect to a horizontal datum plane.

In accordance with these and other objects of the invention there is provided apparatus comprising a device for tilting a support about a fixed base, the device including at least one clamp carried by the support for fixing the support to the fixed base. The clamp comprises first and second clamp jaw members respectively positionable in facing relation against an associated one of two opposite sides of the fixed base. At least one of the clamp jaw members carries a force applying member movable against the associated fixed base side for applying a force against the fixed base. This applied force produces a reaction force in the one clamp jaw member effective to cause tilting of the clamp and correspondingly the support about the fixed base.

The one clamp jaw member advantageously carries two force applying members and these will be as fluid pressure operated pistons. By varying the pressure supplied to each piston, the magnitude of tilting and direction of tilting of the support can be controlled.

In another embodiment of the device, the two pistons can be supplied with equal pressures and tilting direction will be controlled by rotating a rigid component carried on the second clamp jaw member about a pivot on which the rigid component is carried, rotation of the rigid component being with a worm gear engaged with a threaded arcuate edge sector of the rigid component.

A further embodiment of the device uses one pressure piston carried on one clamp jaw element along with a structure defining fulcrum both of which engage one side of the fixed base. On a second clamp jaw element, a rigid component carried on a pivot is located at the opposite side of the fixed base and the rigid component is connected by a shackle to a pressure mounting so that the rigid component can move in each of opposite directions relative to the said fixed base opposite side. With application of different values of pressure to the pressure mounting and the piston, the fixed base at the said one side is held against the fulcrum and is caused to tilt reactively to the forces applied by these pressures to the clamp.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
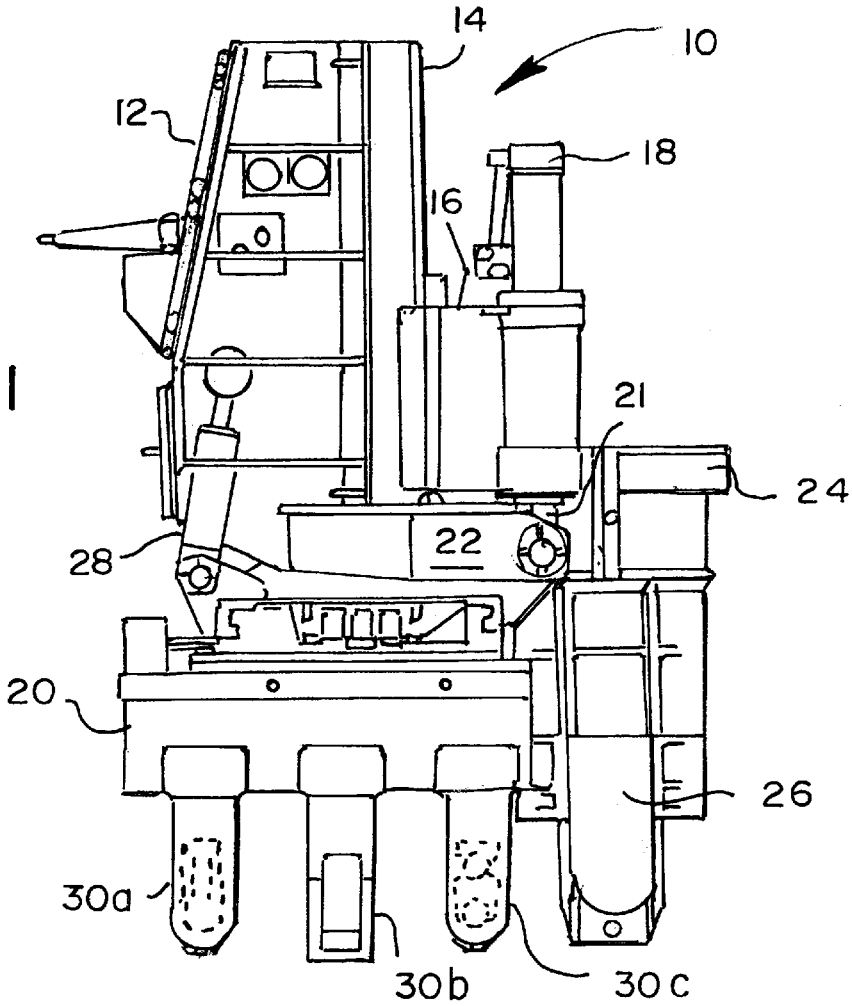
FIG. 1 is a front side elevational view of a pile driver machine in which is embodied support orienting means made in accordance with the present invention.
Figure 2:
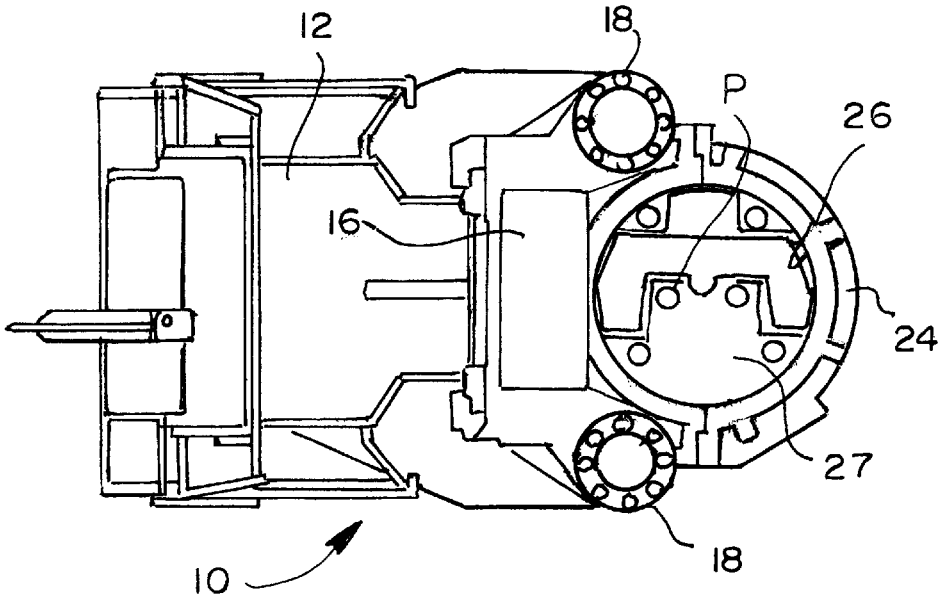
FIG. 2 is a top plan view of the machine.
Figure 3:
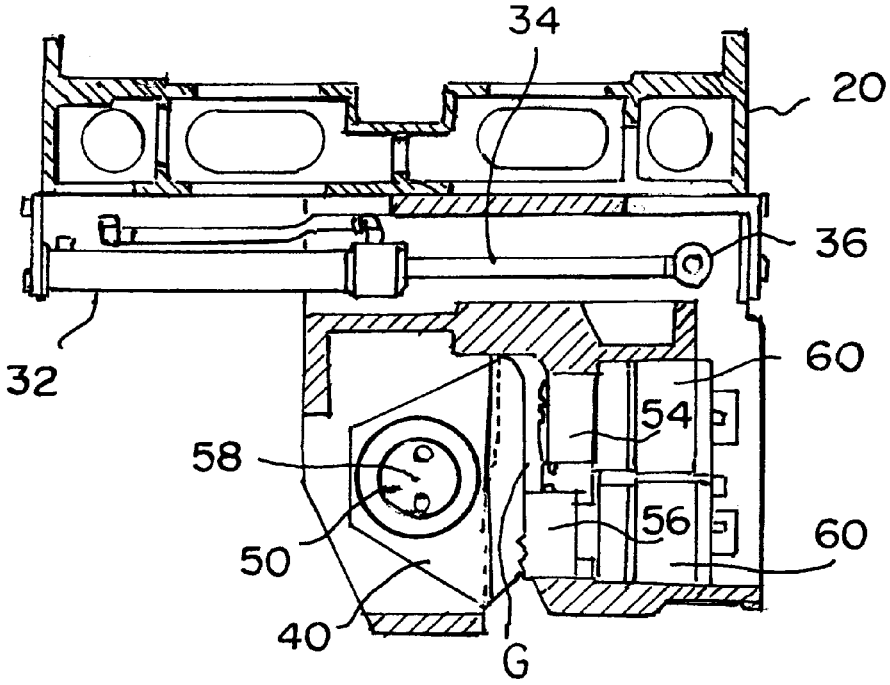
FIG. 3 is a fragmentary transverse sectional view on enlarged scale of the machine depicting the support or table on which the machine carriage is supported and showing one of the clamps carried by the support and with which the support is clamped to a fixed base.

The pile driving machine 10 shown in FIGS. 1–3 is of a type TSM manufactured by Tosa Machinery, which, in addition, includes tilting clamps according to the present invention. Machine 10 comprises a support or table 20 on which is mounted a carriage assembly 12. The carriage assembly includes a vertical guide 14 on which a driver/chuck unit 16 is vertically slidable up and down. Driver/chuck unit 16 includes a pair of power cylinders 18, the stroking rod 21 of which are connected to arms 22 on the carriage assembly, and it further includes a chuck 24 having a pile receptive opening 26, the chuck being closable about the pile P to hold it securely with pile engaging clamps 27 during driving insertion of same into the ground in manner as will be given below later.

The carriage assembly 12 and driver/chuck unit 16 are rotatably mounted on the support 20 to the extent that same can be rotated through an arc of up to 270 degrees to position the chuck 24 at various desired positions at both sides of the machine when required during driving of a pile. The carriage assembly and driver/chuck also are slidable horizontally relative to the support 20 incident advancement of the machine along a pile course in manner depicted in FIGS. 5 and 6 and as will be explained later. The particular means for tilting the carriage assembly and driver/chuck unit are not specially detailed or depicted as one of ordinary skill in the art is familiar with the TSM machine and understands how such is effected.

Figure 5:
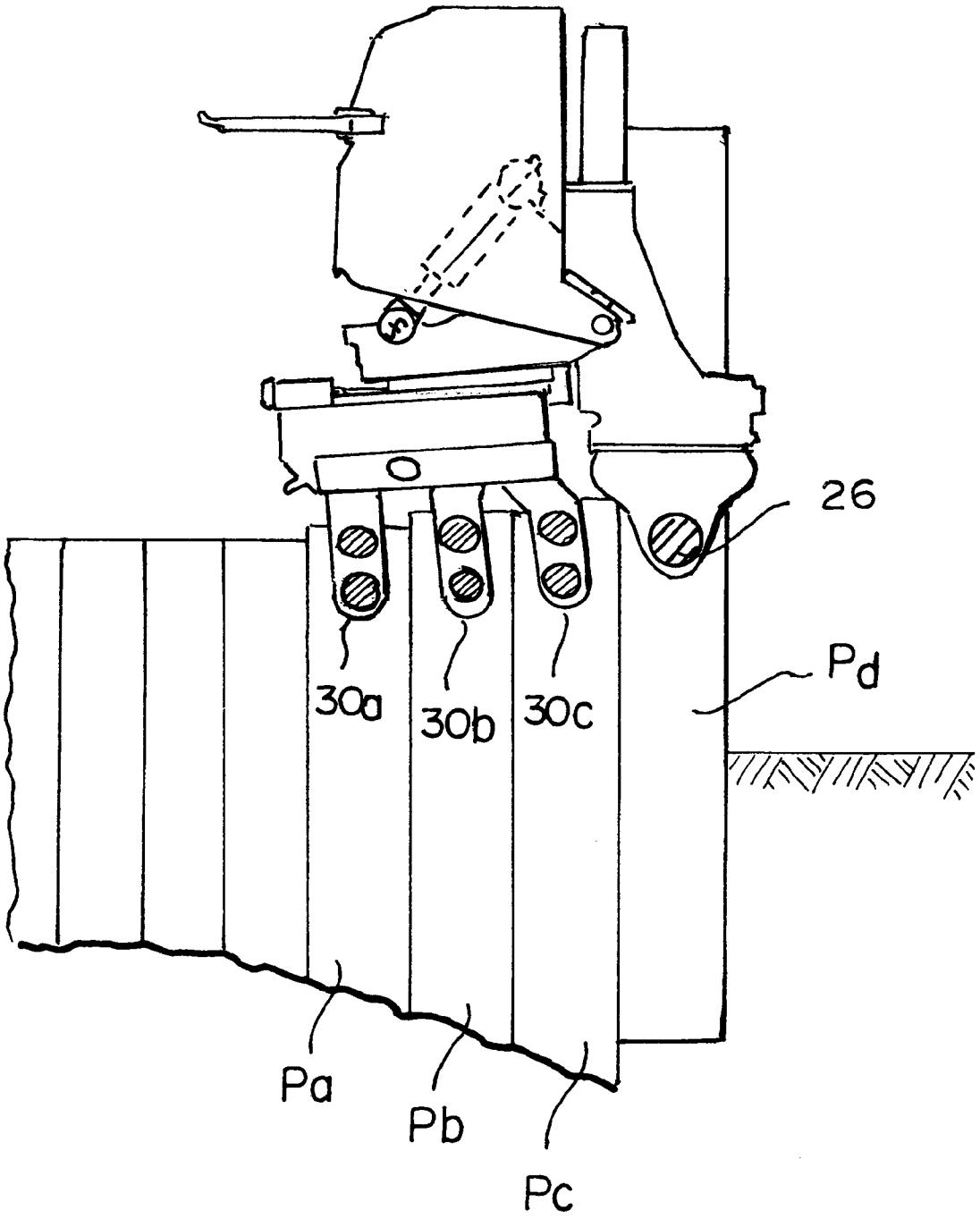
FIG. 5 is a side elevational view showing a pile course installation and illustrates how the clamps can be clamped to previously driven piles to support the machine and to provide the reaction anchor which counters the driving force imposed when a next pile workpiece is being driven into the ground.
Figure 6:
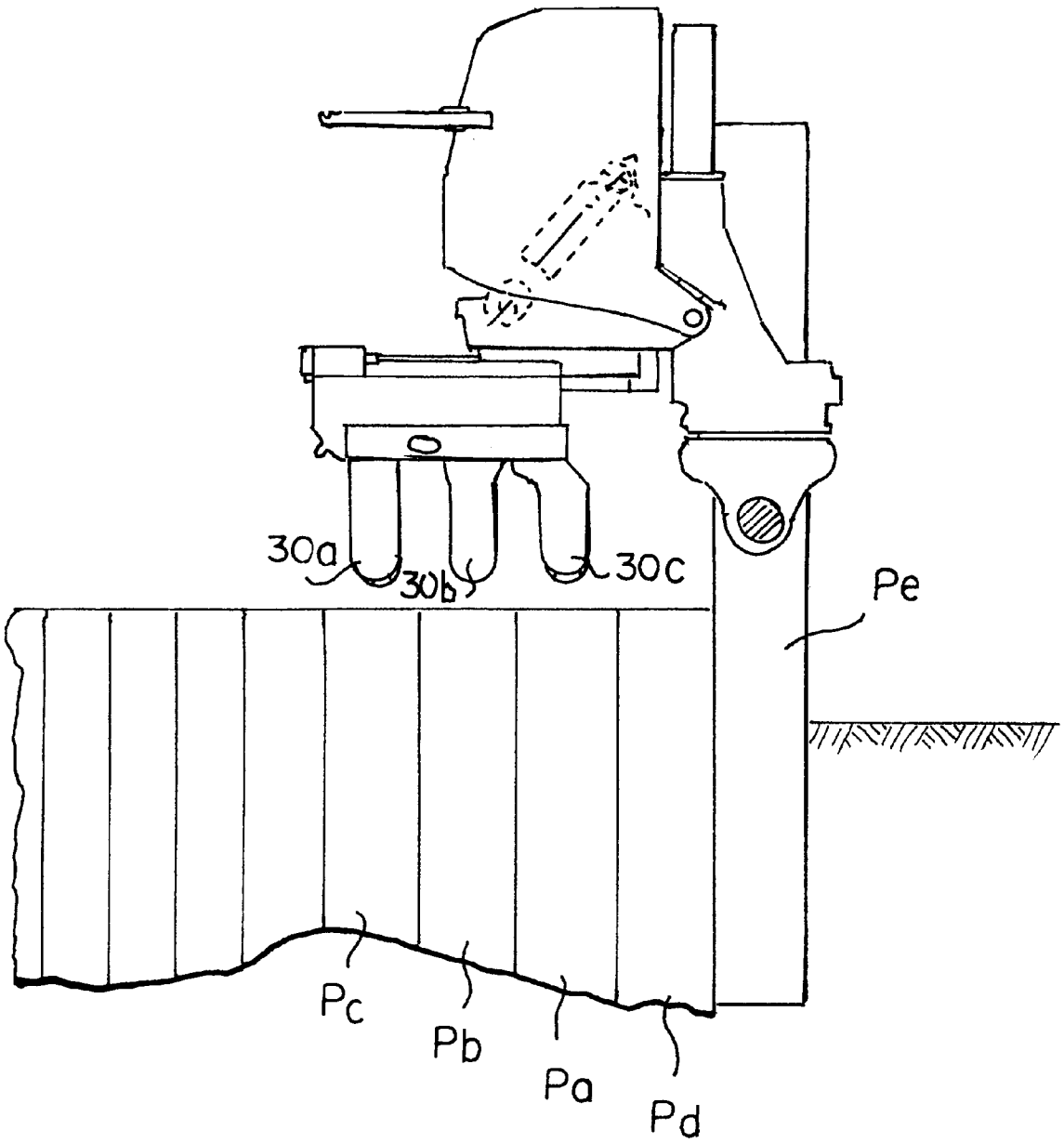
FIG. 6 is a side elevational view similar to FIG. 5 but illustrating the machine mode where the clamps have been unclamped from the fixed base and the machine carriage structure is held elevated on the chuck so that the table or support can be advanced to a new location along the pile course so the machine is positioned to allow further pile workpiece insertion.

Carriage assembly 12 includes tilting cylinder units 28 which can be operated to tilt the assembly relative to the fore and aft of support 20 so that certain angulation of a longitudinal axis of a chuck gripped pile P (FIG. 5) can be set, this tilting being about an axis extending into the viewer in FIGS. 5 and 6 parallel to the horizontal ground plane.

Figure 4:
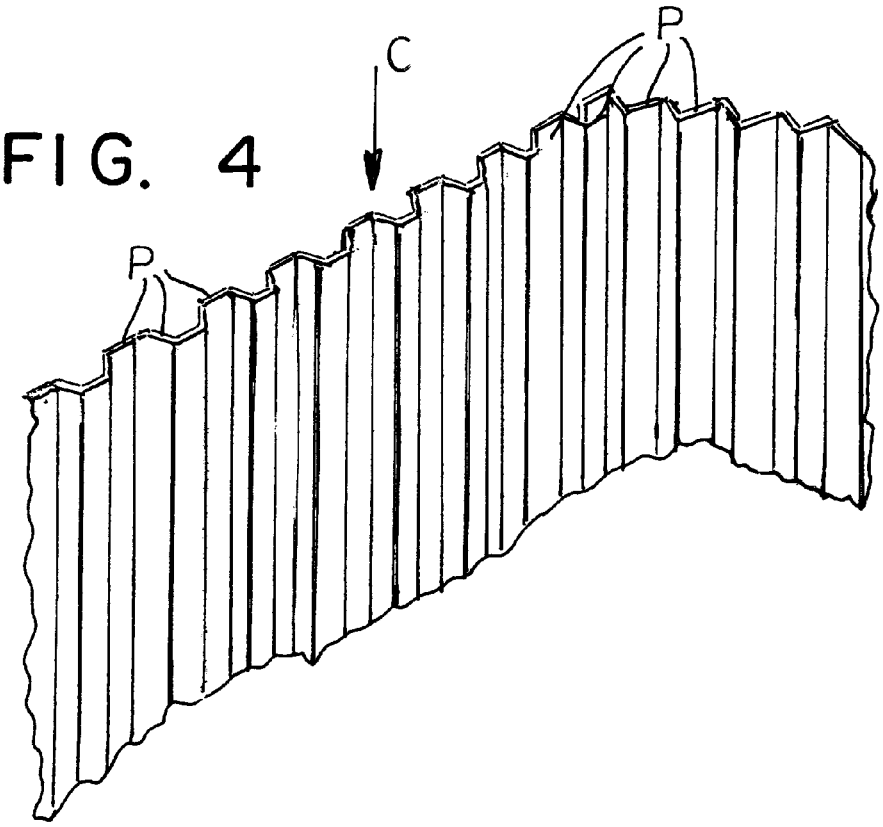
FIG. 4 is a fragmentary perspective view showing a section of piling illustrating how the successive ones of pile workpieces interlock to form a contiguous retainer wall structure, the depicted section showing a corner transition run of the piling.

As seen in FIG. 1, the support 20 carries a number of clamps 30*a*–30*c* by means of which the support 20 (and hence the machine itself) is clamped to a fixed base, the fixed base being several ones of the piles P already driven into the ground along a pile course as shown in FIGS. 5 and 6. An illustrative showing of a pile course is that C made in FIG. 4 wherein it is seen that a contiguous longitudinally coursing array of interlocked or otherwise side edge-to-side edge piles P has been erected, the coursing including, e.g., a transition from a first long course part to another disposed at a right angle to the first part. Particular pile courses are mandated by the contour of ground wherein pile installation is needed, the purpose of the installation such as foundation work, water barrier erection etc.

The clamps 30*a*–30*c* are carried at the underside of the support 20 on structure that allows travel of the clamps laterally of the support during initiation of clamping of same onto the fixed base, such travel involving use of cylinder 32 with its rod 34, the cylinder 32 being attached to the support 20 and the rod as at pin 36 to the structure of the clamps. In some embodiments of commercial machines, three clamps are used—other commercial machines include four clamps. For purposes of the present invention, the description and operation of a single clamp 30 is sufficient to fully disclose the invention.

Returning again to FIGS. 5 and 6, brief description will be given of the manner of utilization of the support clamps 30*a*–30*c* and chuck unit engaging clamps 27 to "walk" the machine along a pile course as is required to reposition the machine because it has effected course driving to a point where the machine no longer has working reach for driver/chuck unit 16 to be positionable over a location at which a next pile P is to be driven.

In FIG. 5, clamps 30*a*–30*c* are clamped to respective prior driven piles Pa–Pc and the chuck unit clamps 27 is gripping a partially driven pile Pd which will be the next to last in the line the machine will be able to drive at that machine location. Since the driving of piles Pa–Pc is illustrated as having resulted in different levels of pile upper ends, the clamps 30*a*–30*c* have engaged the respective pile upper end parts at correspondingly higher/lower locations. Because of such, the right end of the carriage assembly 12 has been tilted to position the driver/chuck unit 16 so it grips the pile P with the longitudinal axis of the pile substantially perpendicular to a horizontal ground or datum plane.

Referring to FIG. 6, after the last pile Pe which the machine at its then location has reach for pile driving, it becomes necessary to advance or walk the machine along the course line. For this, the carriage assembly 12 is elevated while being supported by chuck unit clamps 27 on the last installed pile Pe. The carriage assembly is then slid along the support 20 and when clamp 30*c* is over pile Pd, the carriage is lowered and the clamps 30–30*c* clamped in place on piles 30*b*–30*d*. The machine can then resume pile installation of further piles until a next advance of same is needed.

In the course of installing a line of piles, there are points at which machine position of the contour of ground can create a situation where a gripped pile could be driven with its longitudinal axis disposed at an undesired skew relative to a vertical perpendicular axis, the skewing being crosswise to the advance line of the pile course. Compensating for pile longitudinal axis skewing in a first dimension by using cylinder units 28 to effect right side and left side tilt of the support is described above. On the other hand and to deal with the skew in a second dimension, i.e., crosswise to the advance line, the machine 10 is in accordance with the invention provided with means to tilt the support 20 in a front side and rear side sense and with a means and manner involving use of the FIG. 1 depicted clamps 30*a*–30*c* to allow same.

Figure 7:
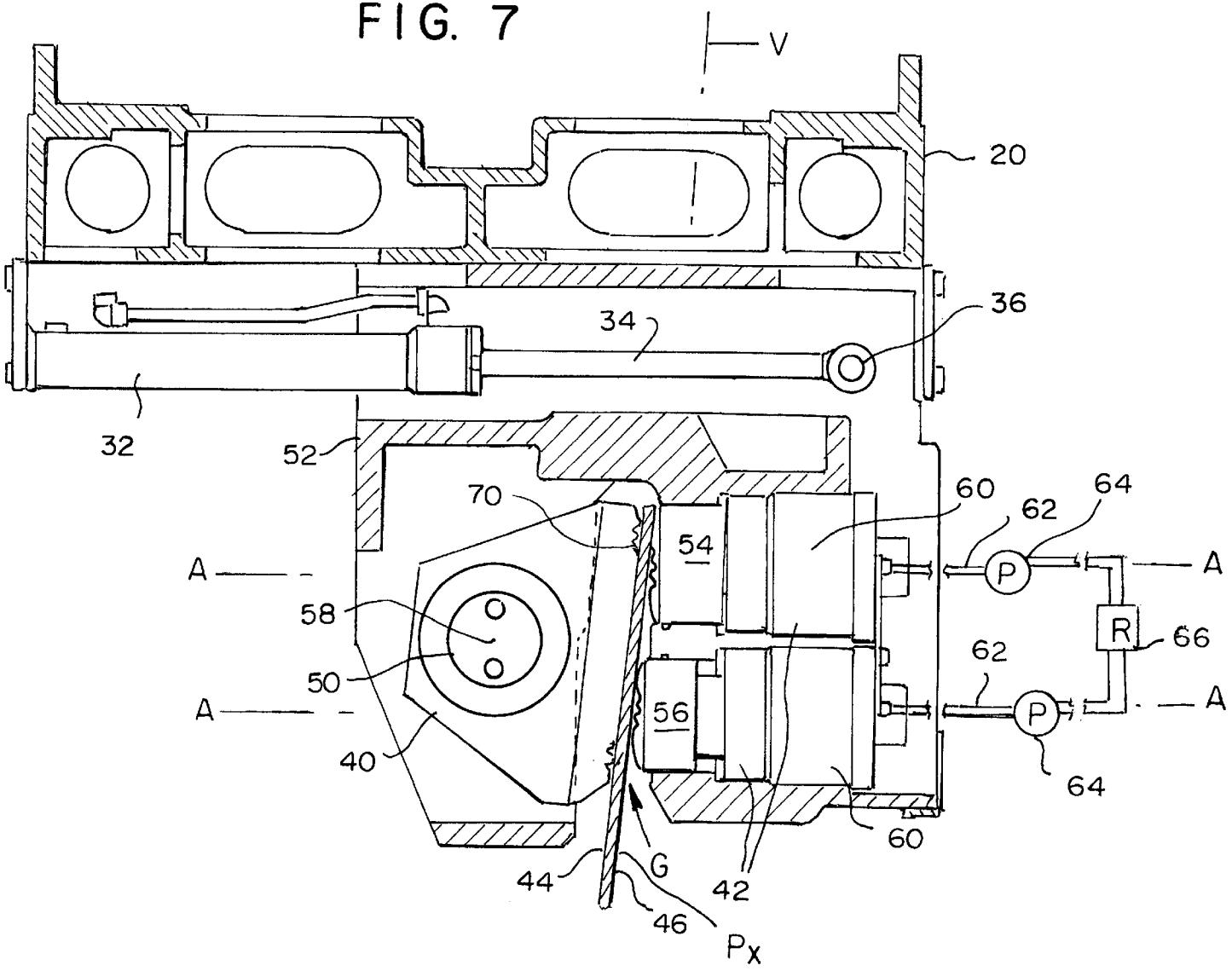
FIG. 7 is a view like FIG. 3 but on more enlarged scale and showing the manner of clamping the support to the fixed base as well as pistons carried on the one of the clamp jaw elements and used to clamp the clamp jaw elements in place at the top of a pile workpiece and with use of a piston differential pressure effecting rotation of the table or support so as to orient the longitudinal axis of a machine gripped workpiece in a predetermined angular relationship with a horizontal datum plane.

Referring now to FIGS. 3 and 7, support orienting or tilting means is constituted by these clamps which gird the fixed base and each comprise an opposed pair of clamp jaw elements 40, 42 defining a gap G, the two jaw elements being disposed each at a corresponding one of the two sides 44, 46 of an upper end part of the pile Px serving as a fixed base. One jaw element 40, a rigid component is received on and is rotatable in respect of a pivot 50 rigid on a clamp housing structure 52. The second jaw element 42 carries a pair of parallel spaced pistons 54, 56 at least one of which is slidably movable toward and away from the fixed base side associated therewith. As is seen from FIG. 7, the pistons 54, 56 are arrayed such that an axis 58 of the pivot 50 is located centrally between longitudinal axes A of the pistons.

Conveniently, the pistons 54, 56 are each received in a housing 60 and operable to be stroked by a force applied thereto that causes them to slide toward and away from the fixed base. Where pistons are used, a pressurized fluid flow actuates piston sliding. Each piston has its own separate pressurized fluid supply line 62 from its own control 64 which may be connected to a common fluid supply tank 66. Operation of the support orienting means follows next.

When a clamp 30*a*–30*c* is inserted on an upper end, above ground part of a driven pile Px and pistons 54, 56 are actuated to bring jaw elements 40, 42 close against the sides of the pile, a flat face 70 of jaw element 40 rotates to make full contact with its associated fixed base side. Actuating piston 56 with fluid pressure causes the piston to slide against its associated fixed base side. Piston 54 is held at its shown position under less pressure than piston 56. As the pistons are offset from pivot 58, a force couple is applied by piston 56 against pile Px but since the pile can not move, a reaction force is produced and transmitted through jaw element 42 that causes the first jaw element and the whole clamp structure, together with support 20 to reactively undergo a tilting displacement. The extent of tilting will be determined by the differential of pressures supplied to the pistons 54, 56 and maintenance of contact of the pistons with the pile side face. In effecting counterclockwise rotation of the support 20, i.e., tilt to the front side, piston 56 extends under the greater pressure, and piston 54 retracts under the lesser pressure.

The tilt of the support allows adjusting the longitudinal axis of the pile in the machine chuck in vertical disposition. If it is desired to tilt the support rearwardly, the pressure acting on piston 54 would be greater than that acting on piston 56 in which case, the support 20 would rotate clockwise about axis 58 with piston 54 extending and piston 56 retracting.

Figure 8:
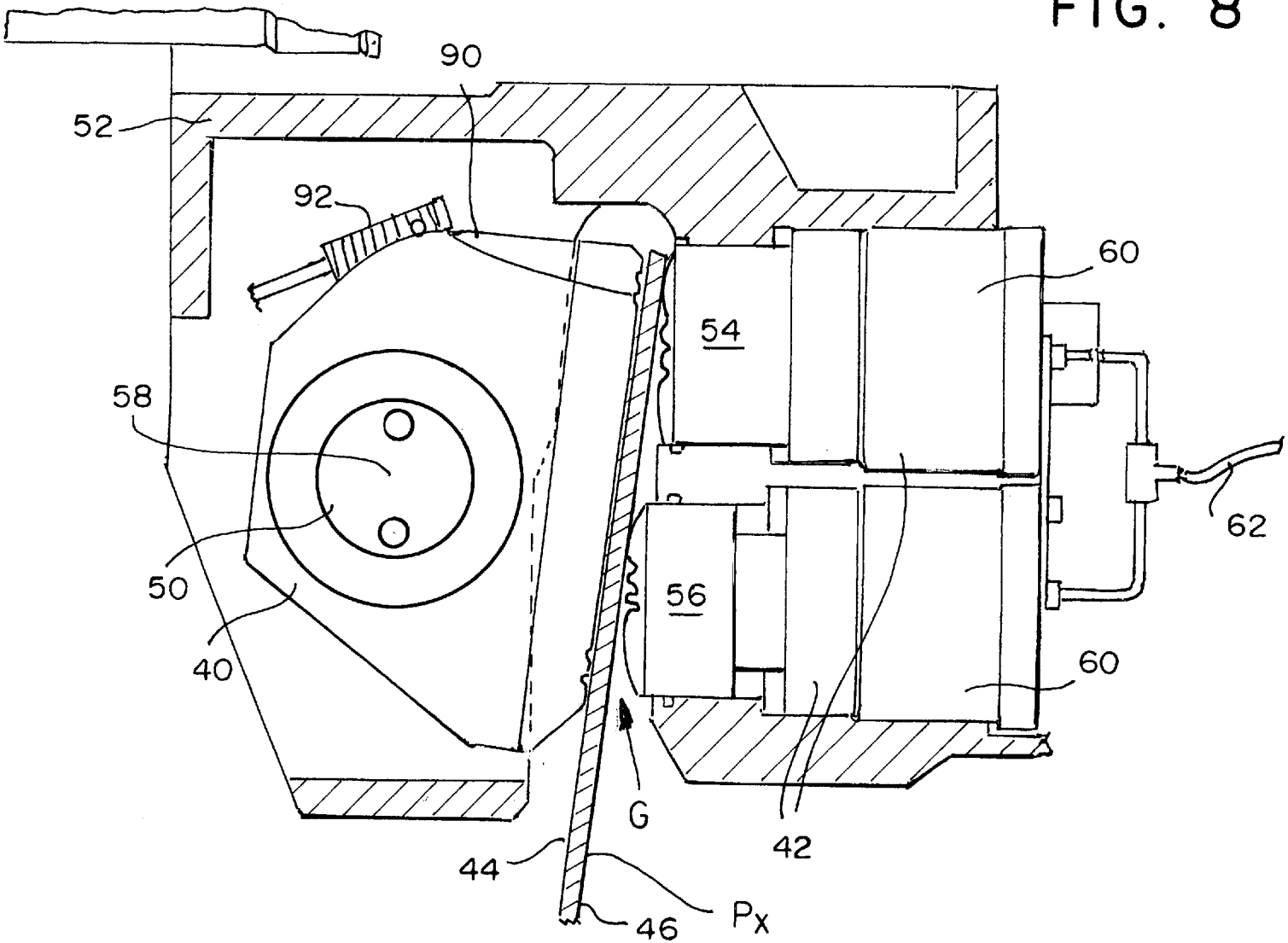
FIG. 8 is a view similar to FIG. 3, in which the angle of the clamp jaw is fixed by, for example, a worm gear.

Referring now to FIG. 8, instead of furnishing different fluid pressures to housings 60 to control the tilt angle, the angle of jaw element 40 is controlled positively in any convenient manner, while the same fluid pressure from a single pressurized fluid supply line 62 is applied to both housings 60. Tilt angle control may be accomplished, for example, by forming an upper surface 90 of jaw element 40 in a semicircular arc, with suitable threadings in its surface. The threadings on upper surface 90 mesh with a worm gear 92 engaged therewith. Worm gear 92 is rotated by any conventional drive device (not shown) to rotate jaw element 40 to the desired angle about its axis 58. Then, when fluid pressure is applied to housings 60, piston 54 and piston 56 extend outward, forcing side 44 into contact with the face of jaw element 40. In this manner, the desired tilt angle of clamp housing structure 52, and the remainder of the pile driver, is established at the preset angle of jaw element 40.

Figure 9:
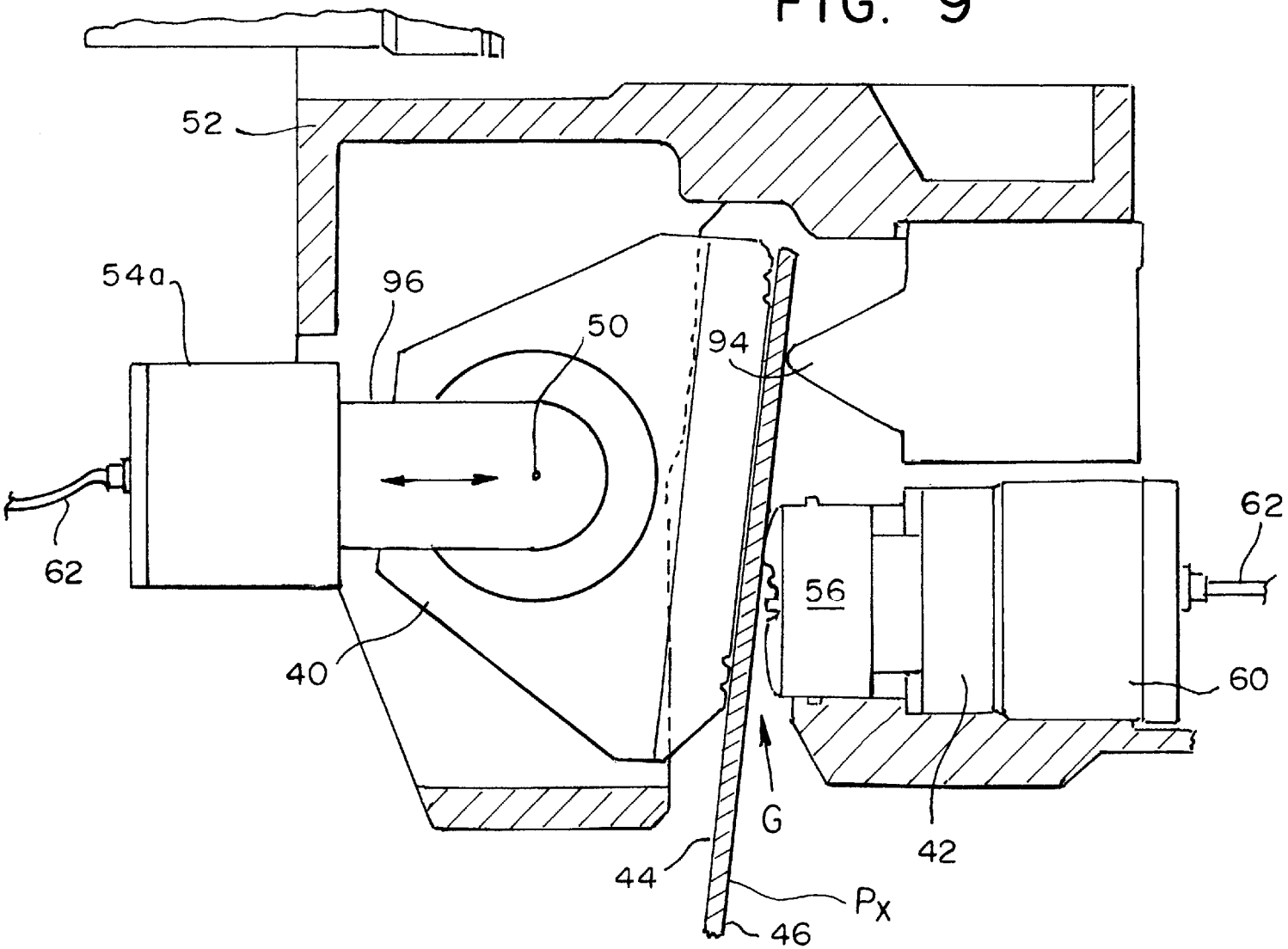
FIG. 9 is a view similar to FIG. 3, wherein one of the pistons at one side of the gap is replaced with a fixed clamping element, and a second piston is disposed at the opposed side of the gap.

Referring now to FIG. 9, an embodiment of the invention is shown in which only piston 56 faces side 46. A non-moving rounded chisel fulcrum point 94 faces side 46 at a position spaced upward from piston 56. A second piston 54*a* is fixed to clamp housing structure 52 and is connected through a shackle 96 to pivot 50 centered in the rotational axis of jaw element 40. Jaw element 40 is free to move in translation under urging by shackle 96. Pistons 56 and 54*a* receive independent supplies of fluid pressure from respective pressurized fluid supply lines 62. As will be evident from an examination of FIG. 9, the interplay of forces between piston 56 and jaw element 40 always urges side 46 into firm contact with chisel point 94. The relative pressures of fluid independently supplied to pistons 56 and 54*a* tends to rotate the remainder of the apparatus about chisel point 94, and thereby control the tilt of the tool to which it is attached.

Figure 10:
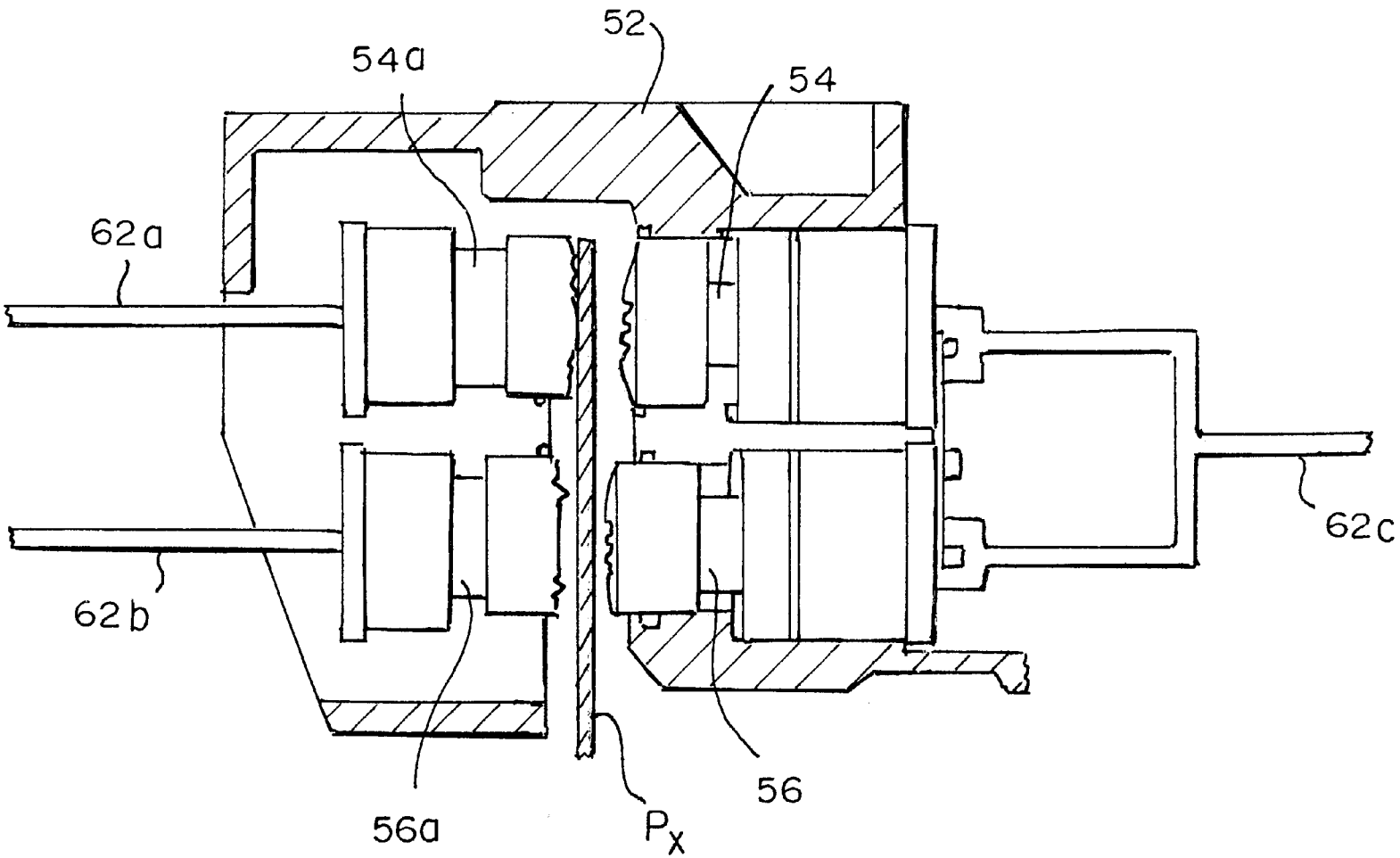
FIG. 10 is a partial cross section of clamp jaw elements using opposed pairs of clamping pistons.

Referring now to FIG. 10, an embodiment of the invention is shown in which pistons 54 and 56 are opposed by pistons 54*a* and 56*a*, respectively. Pistons 54 and 56 receive the same fluid pressure from a common fluid supply line 62*c*. Pistons 54*a* and 56*a* receive independently controlled fluid pressures from fluid supply lines 62*a* and 62*b*. The relationship between the three fluid pressures determines the transverse location of pile Px within clamp housing structure 52. The relationship between the fluid pressures on fluid supply lines 62*a* and 62*b* determines the tilt of clamp housing structure 52.

Figure 11:
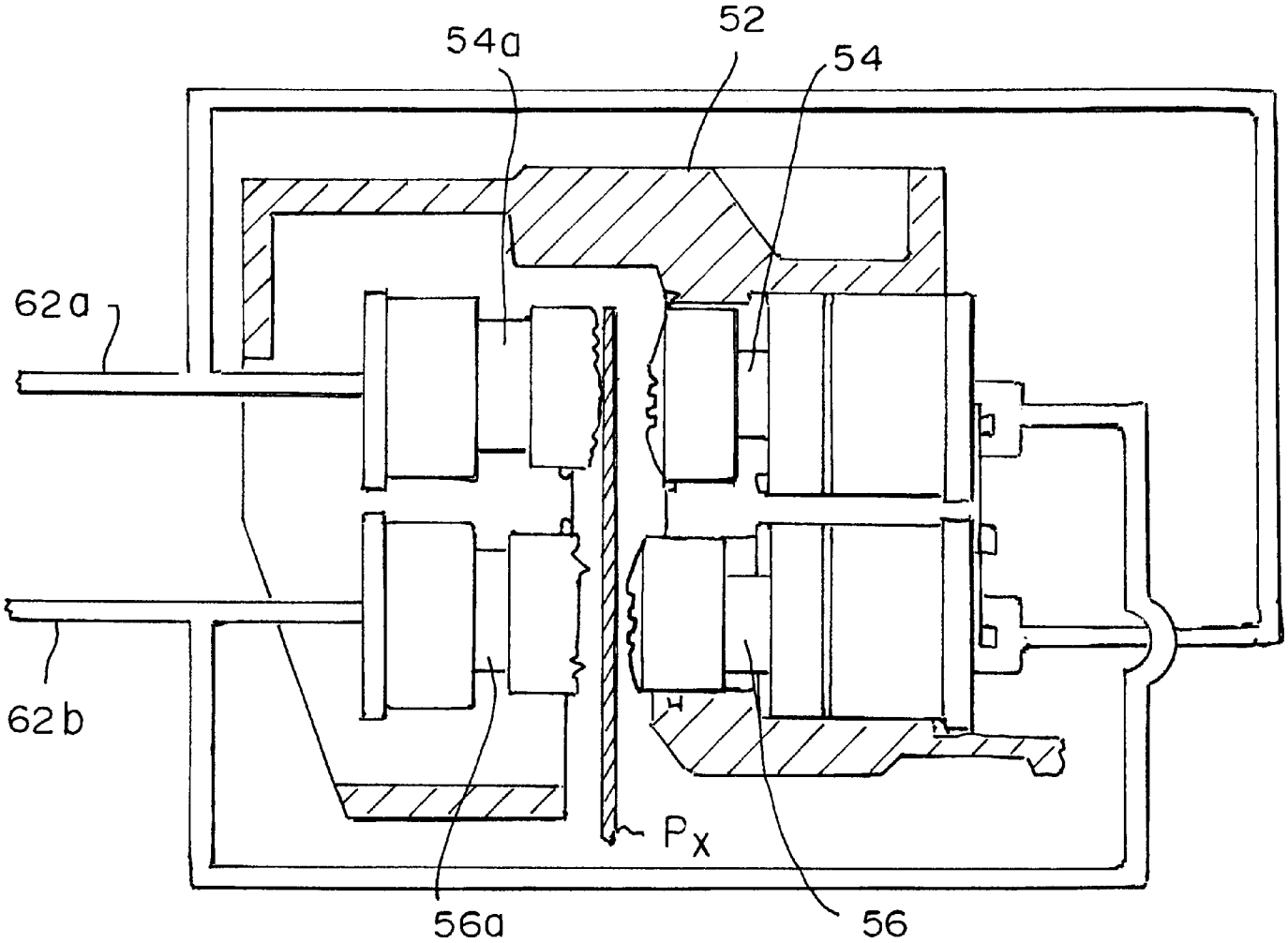
FIG. 11 is a partial cross section of clamp jaw elements in which opposed pairs of clamping pistons receive pressurized fluid from crossed fluid supplies.

Referring now to FIG. 11, a four-piston embodiment is shown in which independent fluid pressure supplies on fluid supply lines 62*a* and 62*b* are cross-supplied to oppositely opposed pairs of pistons. That is, the fluid pressure on fluid supply line 62*a* is fed to pistons 54*a* and 56, and the fluid pressure on fluid supply line 62*b* is fed to pistons 56*a* and 56. Differences in fluid pressures on fluid supply lines 62*a* and 62*b* determine the tilt of clamp housing structure 52, and the tool to which it is affixed. Unlike the embodiment of FIG. 10, this embodiment lacks provision for transverse control of the position of piling Px within clamp housing structure 52.

Figure 12:
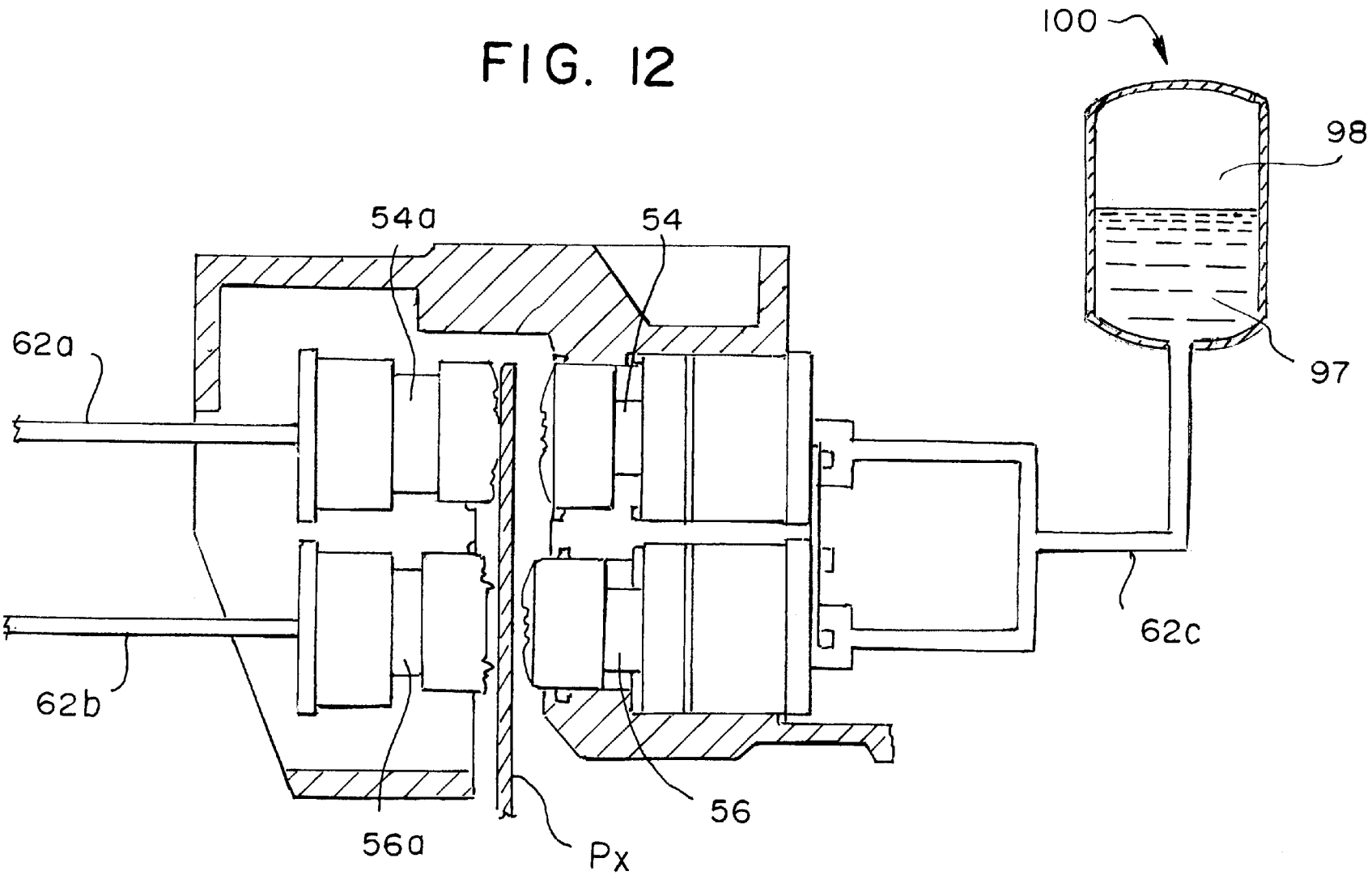
FIG. 12 is a partial cross section of clamp jaw elements having opposed pairs of clamping pistons in which clamping pistons on one side receive independent fluid supplies and clamping pistons on the other side are connected to an accumulator.

Referring now to FIG. 12, a further four-piston embodiment is shown in which pistons 54*a* and 56*a* receive independently controlled fluid pressures on fluid supply lines 62*a* and 62*b* respectively. Pistons 54 and 56 are commonly connected through fluid supply line 62*c* to an accumulator 100. As is conventional, accumulator 100 includes a liquid-filled volume 97 and a gas-filled volume 98. In some conventional accumulators 100, the liquid and gas are separated by a flexible membrane (not shown).

Transverse positioning of pile Px is controlled by the total combination of pressures on pistons 54*a* and 56*a*. This transverse positioning is permitted by the compressibility of the gas in gas-filled volume 98. The gas in gas-filled volume 98 is initially pressurized to establish the amount of pressure on pistons 54*a* and 56*a* required to establish a given transverse position of pile Px.

Figure 13:
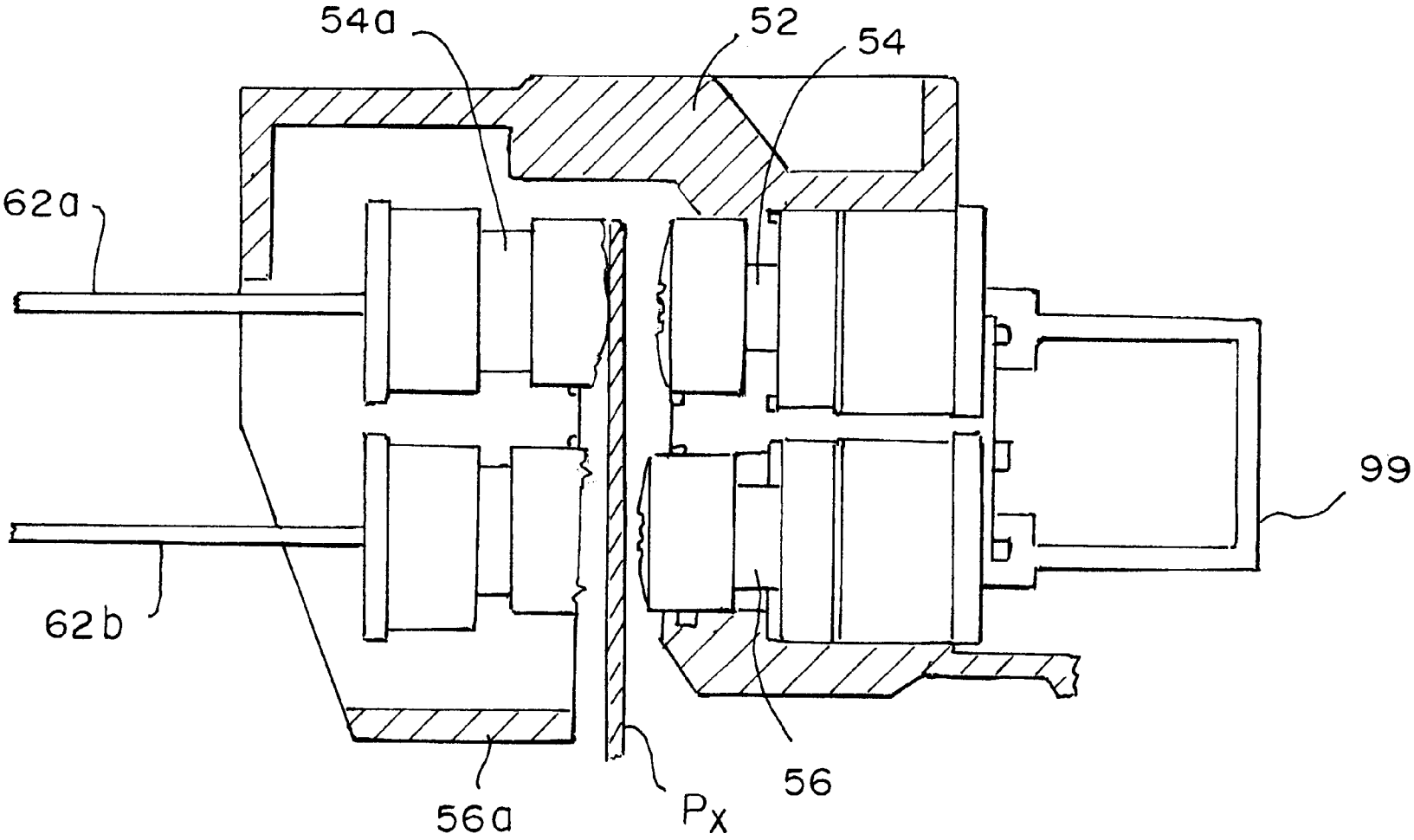
FIG. 13 is a partial cross section of clamp jaw elements having opposed pairs of clamping pistons in which pistons on one side receive independent fluid supplies and clamping pistons on the other side are interconnected with incompressible fluid filling the pistons and the interconnection line.

Referring now to FIG. 13, a still further four-piston embodiment is shown in which fluid in pistons 54 and 56 is directly interconnected on an interconnect line 99. When the fluid in pistons 54 and 56 and interconnect line 99 is incompressible, as is contemplated in the preferred embodiment, pistons 54 and 56 advance or retract in response to the combination of pressures fed to pistons 54*a* and 56*a*. This embodiment lacks transverse control of the position of pile Px.

In addition to the described function of driving piles, the pile driver apparatus is also capable of pulling previously driven piles from the earth. One skilled in the art, with the above description for reference will be fully capable of understanding the technique for pulling pilings. Briefly, the pile driver is clamped to previously driven piles and the chuck is lowered and then clamped to the pile to be pulled. Then the chuck is raised to pull the pile upward in increments the extent of travel of the chuck. In some cases, where the pile is especially difficult to remove, as at the beginning of removal, a crane may be connected to the upper end of the pile to add it's upward force to the withdrawal force of the pile driver. Near the end of the withdrawal process, the upward force available from the crane may be sufficient, by itself, to complete the withdrawal process.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Device for tilting a support about a fixed base, the fixed base having opposite sides, the device comprising, at least one clamp carried by the support for fixing the support to the fixed base, said one clamp including a pair of opposed jaw elements, one jaw element being positioned at one of said fixed base opposite sides, a second of said jaw elements being positioned at a second of said fixed base opposite sides, said one jaw element having a flat face for engaging said one fixed base opposite side and being mounted on a pivot, said second jaw element comprising a pair of fluid operated pistons, each of said pistons having a separate pressurized fluid supply line and control, an axis of said pivot being located centrally between longitudinal axes of the pistons; the pistons being slidably movable along their respective longitudinal axes toward said fixed base second opposite side to engage therewith, application of fluid pressure at a lower or no value to one piston and at a higher value to the other of said pistons producing with the piston to which the higher value of pressure is applied a force against the said fixed base second opposite side that causes a reaction force in the support for rotating the support about said pivot.

* * * * *